US009664407B2

(12) United States Patent
Sakoda et al.

(10) Patent No.: US 9,664,407 B2
(45) Date of Patent: May 30, 2017

(54) INDOOR UNIT FOR AIR-CONDITIONING APPARATUS WITH FAN BELLMOUTH AND MOTOR STAY

(75) Inventors: Kenichi Sakoda, Chiyoda-ku (JP); Tomoya Fukui, Chiyoda-ku (JP); Takashi Matsumoto, Chiyoda-ku (JP); Shoji Yamada, Chiyoda-ku (JP); Akira Takamori, Chiyoda-ku (JP); Masayuki Oishi, Chiyoda-ku (JP); Toshinori Nakamura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 217 days.

(21) Appl. No.: 14/408,142

(22) PCT Filed: Jul. 3, 2012

(86) PCT No.: PCT/JP2012/004295

§ 371 (c)(1),
(2), (4) Date: Dec. 15, 2014

(87) PCT Pub. No.: WO2014/006649

PCT Pub. Date: Jan. 9, 2014

(65) Prior Publication Data

US 2015/0168008 A1 Jun. 18, 2015

(51) Int. Cl.
*F24H 3/06* (2006.01)
*F24F 13/08* (2006.01)
(Continued)

(52) U.S. Cl.
CPC ..... *F24F 13/08* (2013.01); *F04D 29/544* (2013.01); *F04D 29/666* (2013.01);
(Continued)

(58) Field of Classification Search
CPC ..... F24F 13/08; F24F 13/082; F24F 13/24; F24F 1/0029; F04D 29/544; F04D 29/666
(Continued)

(56) References Cited

U.S. PATENT DOCUMENTS 5,466,120 A * 11/1995 Takeuchi ..... F04D 29/703 415/119
5,507,691 A * 4/1996 Nishizawa ..... F24F 13/08 454/279
(Continued)

FOREIGN PATENT DOCUMENTS

DE 10 2005 023 868 B3 7/2006
JP 2 37198 2/1990
(Continued)

OTHER PUBLICATIONS

Foreign Document JP 02-037198 and Abstract Translation.*
(Continued)

*Primary Examiner* — Len Tran
*Assistant Examiner* — Claire Rojohn, III
(74) *Attorney, Agent, or Firm* — Oblon, McClelland, Maier & Neustadt, L.L.P.

(57) ABSTRACT

In an indoor unit for an air-conditioning apparatus, a downstream edge of each of the blades of the fan of an air-blowing device, when viewed in plan view, intersects any of the members of a motor stay of the air-blowing device irrespective of an angle of rotation of the fan. The motor stays are connected to the mounting portions of a bellmouth in which the fan is disposed, wherein the mounting portions protrude downward from a downstream outlet end of the bellmouth and each include side surfaces, of which at least a first side surface opposing a pressure surface of each of the blades of the fan is at an angle relative to a rotation axis of the fan.

11 Claims, 6 Drawing Sheets

(51) Int. Cl.

| | |
|---|---|
| ***F24F 13/24*** | (2006.01) |
| ***F24F 1/00*** | (2011.01) |
| ***F04D 29/54*** | (2006.01) |
| ***F04D 29/66*** | (2006.01) |

(52) U.S. Cl.
CPC ..... *F24F 1/0029* (2013.01); *F24F 13/082* (2013.01); *F24F 13/24* (2013.01)

(58) Field of Classification Search
USPC ..... 165/121, 122, 125; 417/423.14, 423.3, 417/423.15, 423.1
See application file for complete search history.

(56) References Cited

U.S. PATENT DOCUMENTS

| | | | | |
|---|---|---|---|---|
| 6,139,265 | A * | 10/2000 | Alizadeh | F04D 29/544 415/208.1 |
| 6,142,733 | A * | 11/2000 | Alizadeh | F04D 29/544 415/208.2 |
| 6,398,492 | B1 | 6/2002 | Cho et al. | |
| 7,083,387 | B2 * | 8/2006 | Chen | F04D 29/325 416/189 |
| 7,220,102 | B2 * | 5/2007 | Cho | F04D 29/544 415/211.2 |
| 7,588,419 | B2 * | 9/2009 | Hong | F04D 29/547 415/211.2 |
| 8,696,305 | B2 * | 4/2014 | Farlow | F04D 29/541 415/121.2 |
| 2005/0271529 | A1 * | 12/2005 | Stommel | F01P 5/06 417/423.14 |
| 2008/0188174 | A1 * | 8/2008 | Aminpour | F03D 1/04 454/309 |
| 2009/0129913 | A1 * | 5/2009 | Schutte | F04D 25/10 415/1 |
| 2012/0031139 | A1 * | 2/2012 | Shirota | F24F 1/0029 62/426 |

FOREIGN PATENT DOCUMENTS

| | | | | |
|---|---|---|---|---|
| JP | 02-037198 | * | 7/1990 | F04D 29/00 |
| JP | 5 248662 | | 9/1993 | |
| JP | 5 89899 | | 12/1993 | |
| JP | 6 280567 | | 10/1994 | |
| JP | 10 9198 | | 1/1998 | |
| JP | 2000 205194 | | 7/2000 | |
| JP | 2002 5098 | | 1/2002 | |
| JP | 3099404 | | 4/2004 | |
| JP | 2004 360676 | | 12/2004 | |
| JP | 2005 55063 | | 3/2005 | |
| JP | 2007 218101 | | 8/2007 | |
| JP | 2008 99430 | | 4/2008 | |
| JP | 2011 226291 | | 11/2011 | |
| WO | 2010 089920 | | 8/2010 | |
| WO | 2011 152032 | | 12/2011 | |
| WO | 2012 017479 | | 2/2012 | |

OTHER PUBLICATIONS

Extended European Search Report issued Feb. 23, 2016 in Patent Application No. 12880384.8.
International Search Report Issued Oct. 9, 2012 in PCT/JP12/004295 Filed Jul. 3, 2012.
Combined Office Action and Search Report issued Sep. 1, 2016 in Chinese Patent Application No. 201280074433.0 (with partial English translation and English translation of Categories Cited Documents).

* cited by examiner

INDOOR UNIT FOR AIR-CONDITIONING APPARATUS WITH FAN BELLMOUTH AND MOTOR STAY

TECHNICAL FIELD

The present invention relates to an indoor unit for an air-conditioning apparatus (or air-conditioning-apparatus indoor unit) which includes a casing, an air-blowing device, and a heat exchanger such that the casing accommodates the air-blowing device and the heat exchanger, and also relates to an air-conditioning apparatus including the indoor unit.

BACKGROUND ART

There have been air-conditioning apparatuses each including a casing, an air-blowing device, and a heat exchanger such that the casing accommodates the air-blowing device and the heat exchanger. Such air-conditioning apparatuses include a recently developed air-conditioning apparatus which includes a casing having an air inlet in an upper portion of the casing and an air outlet in lower part of a front surface of the casing, an axial-flow or diagonal-flow air-blowing device disposed downstream of the air inlet within the casing, and a heat exchanger disposed downstream of the air-blowing device within the casing and upstream of the air outlet, the heat exchanger exchanging heat between air discharged from the air-blowing device and a refrigerant (refer to Patent Literature 1, for example).

Examples of related-art axial-flow and diagonal-flow air-blowing devices include an air-blowing device (refer to Patent Literature 2, for example) which includes a frame, a support, serving as a base for a motor fan, disposed to substantially central part of the frame and surrounded by an inner rim of the frame, and a plurality of lattice bars extending between the support and the inner rim of the frame and another air-blowing device (refer to Patent Literature 3, for example) which includes a motor frame including a plurality of radially extending stays, a fan motor held by the motor frame, and a fan connected to a rotating shaft of the fan motor. In the latter air-blowing device, the fan includes N1 (N1 is an integer of 2 or greater) blades and one surface of each blade facing the stays passes one surface of a given stay at an angle of approximately a value of 360 degrees divided by N1×N2 (N2 is an integer of 1 or greater) during rotation of the fan.

CITATION LIST

Patent Literature

Patent Literature 1: International Publication No. WO 10/089920 (paragraph[0006], FIG. 1)

Patent Literature 2: Japanese Registered Utility Model No. 3099404 (paragraph[0003], FIG. 2)

Patent Literature 3: Japanese Unexamined Patent Application Publication No. 2002-5098 (claim 1, FIG. 1)

SUMMARY OF INVENTION

Technical Problem

Assuming that a related-art axial-flow or diagonal-flow air-blowing device (disclosed in Patent Literature 2 or 3, for example) is included in an indoor unit for a related-art air-conditioning apparatus (disclosed in Patent Literature 1, for example) in which an air-blowing device is disposed in the vicinity of and upstream of a heat exchanger, a slipstream generated by each blade of a fan of the air-blowing device periodically passes a point at which the heat exchanger is located closest to the fan. In such a case, the slipstream generated by each blade of the fan interferes with the heat exchanger, thus causing abrupt pressure fluctuations on the blade. Disadvantageously, this causes discrete frequency noise unpleasant to the ear.

The present invention has been made to solve the above-described disadvantage and aims to provide an air-conditioning-apparatus indoor unit capable of reducing unpleasant discrete frequency noise caused by interference of a heat exchanger and a slipstream generated by each blade of a fan, and further provide an air-conditioning apparatus including the indoor unit.

Solution to Problem

The present invention provides an indoor unit for an air-conditioning apparatus, the indoor unit including a casing having an air inlet in an upper portion of the casing and an air outlet in lower part of a front surface of the casing, an air-blowing device that includes a bellmouth disposed to the air inlet, one of an axial-flow and a diagonal-flow fan disposed within the bellmouth, a motor for rotating the fan, a motor base holding the motor, and a motor stay connecting the motor base to the bellmouth, and a heat exchanger disposed downstream of the air-blowing device and upstream of the air outlet within the casing. The heat exchanger exchanges heat between air discharged from the air-blowing device and a refrigerant. The fan includes a plurality of blades. The motor stay includes a plurality of rod-shaped members. The motor stay of the air-blowing device is configured such that, in plan view, a downstream edge of each blade of the fan intersects any of the rod-shaped members of the motor stay irrespective of an angle of rotation of the fan.

The present invention further provides an air-conditioning apparatus including the indoor unit according to the present invention.

Advantageous Effects of Invention

According to the present invention, the motor stay (corresponding to the lattice bars in Patent Literature 2 and the stays in Patent Literature 3) connecting the motor base to the bellmouth is configured such that, in plan view, the downstream edge of each blade of the fan intersects any of the rod-shaped members of the motor stay irrespective of the angle of rotation of the fan. Consequently, a slipstream generated by each fan interferes with the motor stay at all times. Thus, the distribution of pressure of a slipstream generated by each blade in one rotation of the fan is made gentle by the motor stay. This reduces abrupt pressure fluctuations on each blade of the fan caused by interference of the heat exchanger and a slipstream generated by the blade, thus reducing generation of discrete frequency noise unpleasant to the ear.

DESCRIPTION OF EMBODIMENTS

Embodiment 1

Figure 1:
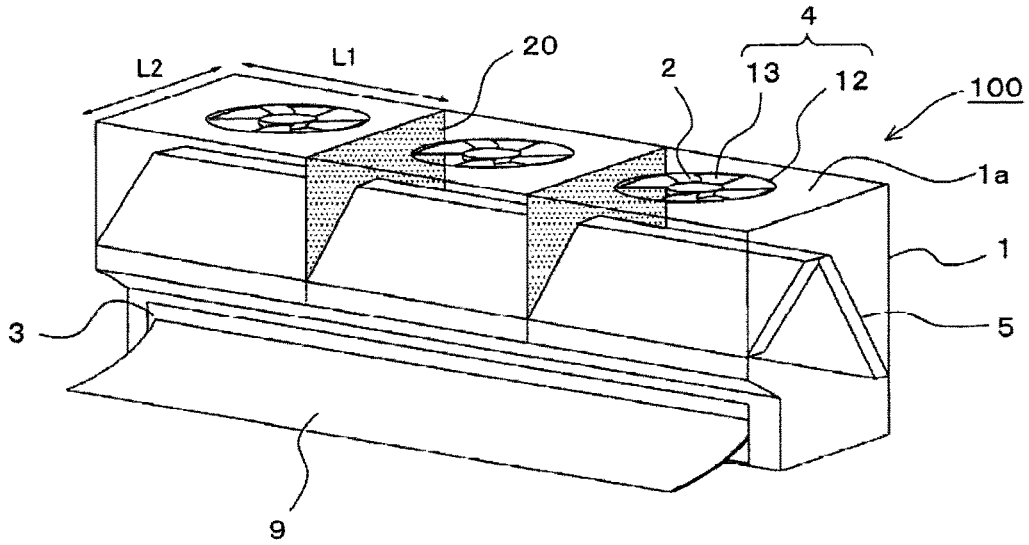
FIG. 1 is a perspective view of an indoor unit for an air-conditioning apparatus according to Embodiment 1 of the present invention.

Embodiments of an indoor unit for an air-conditioning apparatus according to the present invention will be described. Embodiments of the present invention will be described with respect to a wall-mounted indoor unit as an example. Note that each unit (or each component of the unit) may partly differ in shape, size, or the like in the drawings illustrating Embodiments.

Embodiment 1

Figure 2:
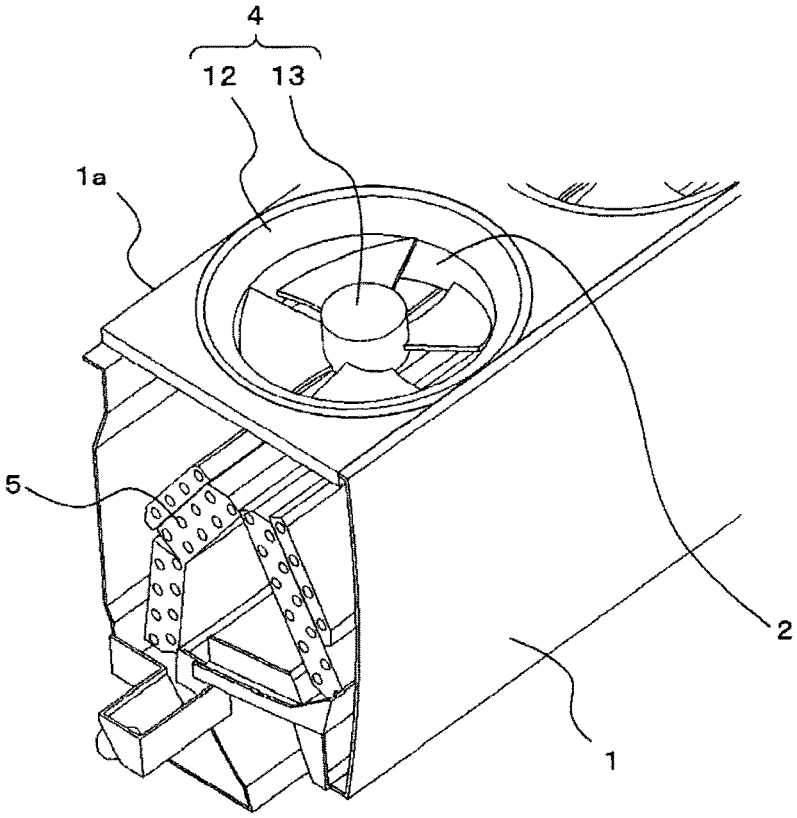
FIG. 2 is a perspective view illustrating an air inlet of the indoor unit and its surroundings in Embodiment 1 of the present invention.
Figure 3:
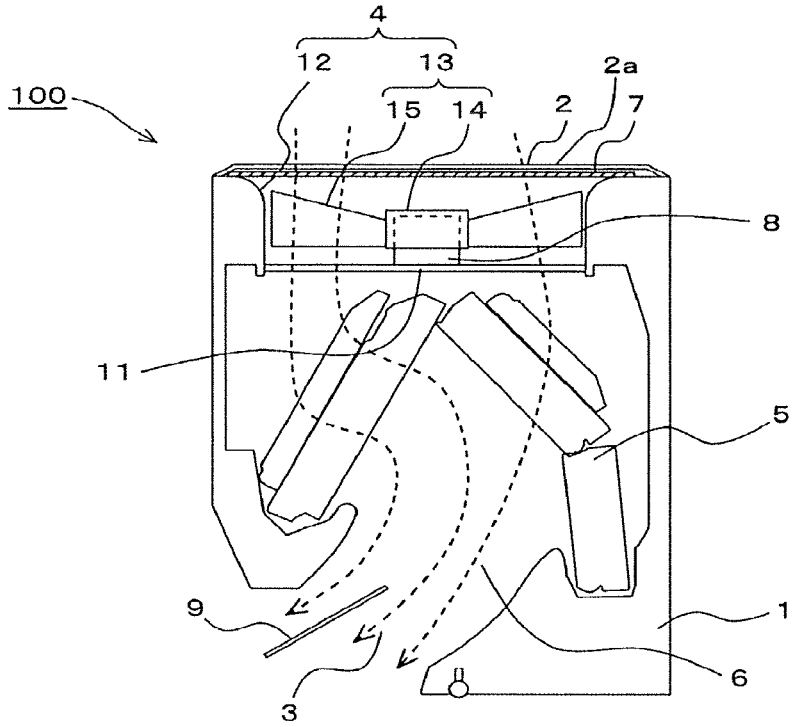
FIG. 3 is a longitudinal cross-sectional view of the indoor unit according to Embodiment 1 of the present invention.

FIG. 1 is a perspective view of an indoor unit for an air-conditioning apparatus according to Embodiment 1 of the present invention. FIG. 2 is a perspective view illustrating an air inlet of this indoor unit and its surroundings for the air-conditioning apparatus. FIG. 3 is a longitudinal cross-sectional view of the indoor unit for the air-conditioning apparatus. FIG. 1 illustrates a see-through view of a casing and allows an internal structure of the indoor unit to be visible. FIG. 2 illustrates a cross-section of a side end portion of the indoor unit.

The entire structure of an indoor unit 100 according to Embodiment 1 will be described in brief with reference to FIGS. 1 to 3.

The indoor unit 100 supplies conditioned air to an air-conditioned space, such as an indoor space, by using a refrigeration cycle through which a refrigerant is circulated. The indoor unit 100 includes a casing 1 having air inlets 2 through which indoor air is taken into the indoor unit and an air outlet 3 through which conditioned air is supplied to the air-conditioned space, axial-flow or diagonal-flow air-blowing devices 4, accommodated in the casing 1, sucking the indoor air from the air inlets 2 and forcing conditioned air to flow through the air outlet 3, and a heat exchanger 5, disposed to a passage between the air-blowing devices 4 and the air outlet 3, exchanging heat between the refrigerant and the indoor air to produce conditioned air.

The air inlets 2 are arranged in an upper portion of the casing 1. The air-blowing device 4 is disposed to each of the air inlets 2. The air-blowing device 4 includes a duct-shaped bellmouth 12 disposed to the air inlet 2 and an axial-flow or diagonal-flow fan 13 disposed within the bellmouth 12. The casing 1 includes a bellmouth support 1*a*, serving as the upper portion of the casing 1. The bellmouth support 1*a* has substantially circular openings, serving as the air inlets 2. The bellmouth 12 is inserted into each opening, thereby attaching the air-blowing device 4 to the casing 1. A fan guard 2*a* and a dust collecting filter 7 are arranged upstream of the air-blowing devices 4 attached to the casing 1. The fan guard 2*a* is disposed to protect a user against touching the fan 13 which is rotating. The dust collecting filter 7 is disposed to prevent dust from flowing into the casing 1. The dust collecting filter 7 is detachable from the casing 1. The air-blowing devices 4 will be described in detail later.

The air outlet 3 is disposed to a lower portion of the casing 1, more specifically, lower part of a front surface of the casing 1. The air outlet 3 is provided with an air flow control vane 9, serving as a mechanism for controlling an air flow direction.

A typical indoor unit for an air-conditioning apparatus suffers from installation space constraints. It is accordingly difficult to increase the air-blowing device 4 in size. According to Embodiment 1, a plurality of (three in FIG. 1) air-blowing devices 4 are arranged along the length of the casing 1 to provide an intended amount of air flow. In Embodiment 1, a partition 20 is disposed between the adjacent air-blowing devices 4. The partitions 20 are used to divide a space defined by the heat exchanger 5 and inner surfaces of the upper portion of the casing 1 (specifically, part of a passage 6 in the casing 1 upstream of the heat exchanger) into areas for the respective air-blowing devices 4. An end of each partition 20 in contact with or in proximity to the heat exchanger 5 is shaped in conformance with the heat exchanger. For example, when the heat exchanger 5 is substantially inverted V-shaped as viewed from left to right in FIG. 1, each partition 20 has a substantially inverted V-shaped end adjacent to the heat exchanger 5. As described above, the passage between the heat exchanger 5 and the air-blowing devices 4 is divided into passages (three passages in Embodiment 1) corresponding one-to-one to the air-blowing devices 4, thus preventing the interference of air flows (swirling flows) produced by the adjacent fans 13. This prevents the flow rate of air supplied to the heat exchanger 5 from varying from part to part of the heat exchanger 5 and further reduces fluid energy loss caused by the interference of swirling flows. The improved distribution of air flow rate and the reduced fluid energy loss achieve a reduction in pressure loss in the indoor unit 100.

In the indoor unit 100 with the above-described structure, the fan 13 of each air-blowing device 4 is rotated to allow indoor air to pass through the dust collecting filter 7, dust in the air is removed, and the air is guided through the bellmouth 12 into the passage in the casing 1. In the heat exchanger 5, the taken indoor air exchanges heat with the refrigerant flowing through the heat exchanger 5, so that conditioned air is produced. The conditioned air is controlled by the air flow control vane 9 so that the air flows in an intended direction, and is then supplied through the air outlet 3 to the air-conditioned space.

The air-blowing device 4 in Embodiment 1 will now be described in detail.

Figure 4:
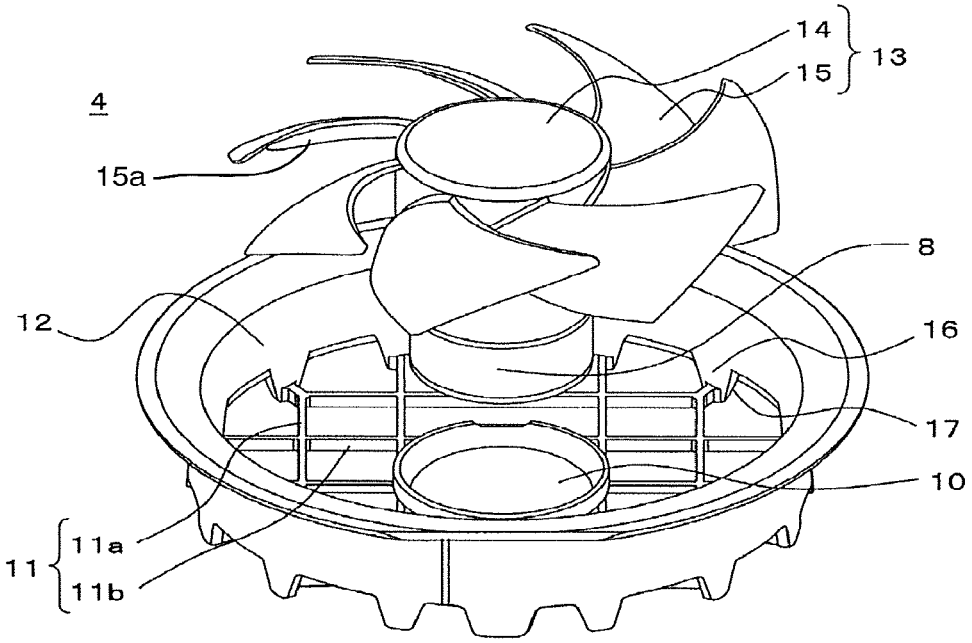
FIG. 4 is an exploded perspective view of an air-blowing device included in each of the indoor unit according to Embodiment 1 of the present invention and an indoor unit for an air-conditioning apparatus according to Embodiment 3 of the present invention.
Figure 5:
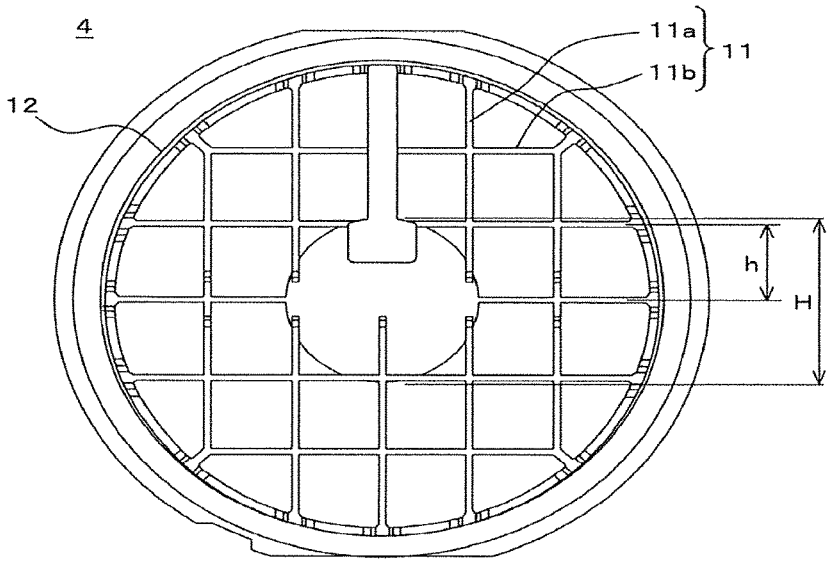
FIG. 5 is a bottom view of the air-blowing device of the indoor unit according to Embodiment 1 of the present invention.

FIG. 4 is an exploded perspective view of the air-blowing device in the indoor unit according to Embodiment 1 of the present invention. FIG. 5 is a bottom view of the air-blowing device.

As described above, the air-blowing device 4 includes the duct-shaped bellmouth 12 and the axial-flow or diagonal-flow fan 13 disposed within the bellmouth 12. The air-blowing device 4 further includes a motor 8 for rotating the fan 13, a motor base 10 holding the motor 8, and a motor stay 11 connecting the motor base 10 to the bellmouth 12.

The fan 13 includes a cylindrical boss 14 and a plurality of blades 15 arranged at a predetermined pitch on an outer circumferential surface of the boss 14. The bellmouth 12 includes an inlet portion that is substantially arcuate in longitudinal sectional view, an intermediate portion that is substantially straight in longitudinal sectional view, and an outlet portion that is substantially arcuate in longitudinal sectional view. Specifically, the bellmouth 12 is shaped such that the inlet portion gradually decreases in diameter and the outlet portion increases in diameter when viewed in the air flow direction in the bellmouth 12. The motor base 10 holding the motor 8 for rotating the fan 13 is disposed at the center of the passage in an outlet of the bellmouth 12. The fan 13 is attached to a rotating shaft of the motor 8 held by the motor base 10. The motor base 10 is secured at the center of the passage in the outlet of the bellmouth 12 by the motor stay 11 connecting the motor base 10 to, for example, an inner surface, which defines the passage, of the bellmouth 12 adjacent to the outlet of the bellmouth 12.

The motor stay 11 includes a plurality of rod-shaped members. In Embodiment 1, the motor stay 11 includes a plurality of rod-shaped members 11*a* arranged at predetermined intervals in plan view and a plurality of rod-shaped members 11*b* arranged at predetermined intervals so as to intersect the rod-shaped members 11*a* at right angles in plan view. In other words, the motor stay 11 in Embodiment 1 is in the form of a lattice composed of the rod-shaped members 11*a* and 11*b* and divides the passage extending through the bellmouth 12 into a plurality of substantially rectangular parts. In Embodiment 1, the distance between the rod-shaped members 11*a* and the distance between the rod-shaped members 11*b* are determined so that a downstream edge (lower edge) of each blade 15 of the fan 13 intersects any of the rod-shaped members 11*a* and 11*b* in plan view irrespective of an angle of rotation of the fan 13. In the motor stay 11 with such a configuration, the downstream edge of each blade 15 intersects the motor stay 11 at a given angle in plan view at all times during rotation of the fan 13 (that is, irrespective of the angle of rotation of the fan 13).

In a typical air-conditioning-apparatus indoor unit in which an air-blowing device is disposed near and upstream of a heat exchanger, when a downstream edge of each blade of a fan passes a point where the fan is located closest to the heat exchanger or a motor stay during rotation of the fan, a slipstream generated by the blade interferes with the heat exchanger or the motor stay, thus causing periodic pressure fluctuations on the blade. Such pressure fluctuations cause discrete frequency noise.

According to Embodiment 1, as described above, the downstream edge of each blade 15 intersects the motor stay 11 at a given angle in plan view at all times during rotation of the fan 13. This arrangement prevents or reduces periodic pressure fluctuations on the blade 15 caused by the interference of the motor stay 11 and the slipstream generated by the blade 15. The slipstream generated by the blade 15 interferes with the motor stay 11 at all times at any angle of rotation of the fan 13. The distribution of pressure of the slipstream generated by each blade 15 in one rotation of the fan is made gentle by the motor stay 11. Consequently, the interference of the heat exchanger 5 and the slipstream generated by each blade 15 is reduced, thus reducing periodic pressure fluctuations on the blade 15 caused by the interference of the motor stay 11 or the heat exchanger 5 and the slipstream generated by the blade 15. This reduces generation of discrete frequency noise unpleasant to the ear and improves low-noise performance of the indoor unit 100.

A noise reducing effect in the indoor unit 100 according to Embodiment 1 was confirmed by tests. This effect will now be described.

Figure 6A:
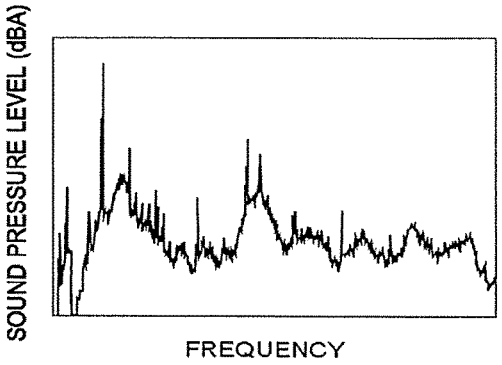
FIGS. 6A-6B include graphs for explaining frequency characteristics of noise in the indoor unit according to Embodiment 1 of the present invention.
Figure 6B:
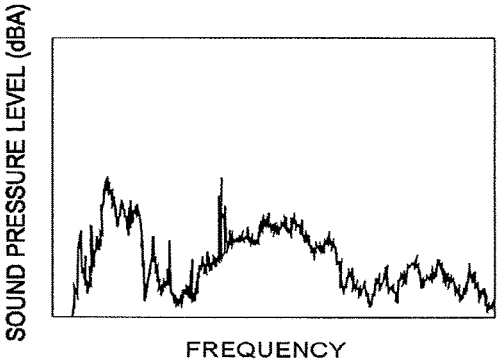

FIG. 6 includes graphs for explaining frequency characteristics of noise in the indoor unit according to Embodiment 1 of the present invention. Specifically, FIG. 6(*a*) illustrates frequency characteristics of noise in an indoor unit including a related-art air-blowing device (in this case, the indoor unit 100 including the related-art air-blowing device disclosed in Patent Literature 2). FIG. 6(*b*) illustrates the frequency characteristics of noise in the indoor unit 100 according to Embodiment 1.

Referring to FIG. 6(*a*), the frequency characteristics of noise in the indoor unit including the related-art air-blowing device have extremely sharp peaks at frequencies at which slipstreams generated by a fan interfered with a motor stay or a heat exchanger. On the other hand, the frequency characteristics of noise in the indoor unit 100 including the air-blowing device 4 according to Embodiment 1 have no extremely sharp peaks at frequencies at which slipstreams generated by the fan 13 interfered with the motor stay 11 or the heat exchanger 5, as illustrated in FIG. 6(*b*). No discrete frequency noise unpleasant to the sense of hearing was generated.

The influence of the distance between the adjacent rod-shaped members of the motor stay 11 in the lattice form (or having substantially rectangular openings) was confirmed by tests. The influence will now be described.

Figure 7:
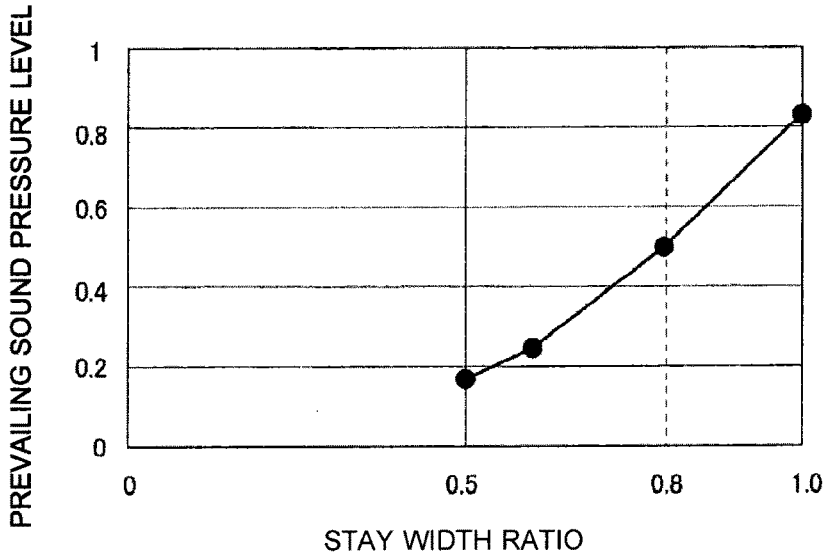
FIG. 7 is a graph illustrating the relationship between a prevailing sound pressure level and the distance between adjacent rod-shaped members included in a motor stay of the indoor unit 100 according to Embodiment 1 of the present invention.

FIG. 7 is a graph illustrating the relationship between a prevailing sound pressure level and the distance between the adjacent rod-shaped members of the motor stay in the indoor unit 100 according to Embodiment 1 of the present invention. In FIG. 7, the axis of abscissas indicates the ratio (stay width ratio h/H) of the distance, h, between the adjacent rod-shaped members of the motor stay 11 to the width, H, of the motor base 10 (refer to FIG. 5). The axis of ordinates indicates the prevailing sound pressure level normalized by using a prevailing sound pressure level in the indoor unit including the related-art air-blowing device as 1.

As illustrated in FIG. 7, the prevailing sound pressure level was reduced by half at a stay width ratio of 0.8 or less. Thus, the stay width ratio is preferably less than or equal to 0.8 to achieve the effect of reducing discrete frequency noise.

Embodiment 2

In Embodiment 1, the motor stay 11 is shaped so as to have substantially rectangular openings defined by the rod-shaped members 11*a* and 11*b*. The motor stay 11 may have any shape. It is only required that the downstream edge of each blade 15 intersects the motor stay 11 at a given angle in plan view at all times. For example, the motor stay 11 may have, for example, circular, elliptic, or triangular openings.

Furthermore, the motor stay 11 may include aerodynamic rod-shaped members. Moreover for example, the motor stay 11 may be shaped as follows. Note that the components which will not be mentioned in Embodiment 2 are the same as those in Embodiment 1 and the same parts and components as those in Embodiment 1 are designated by the same reference numerals.

Figure 8:
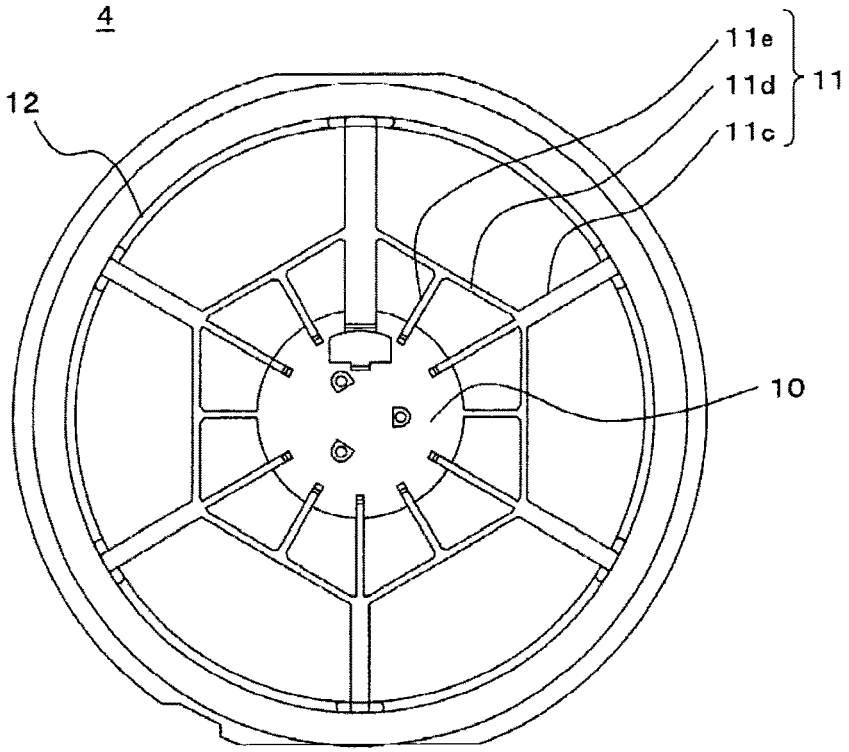
FIG. 8 is a bottom view of an exemplary air-blowing device included in an indoor unit for an air-conditioning apparatus according to Embodiment 2 of the present invention.
Figure 9:
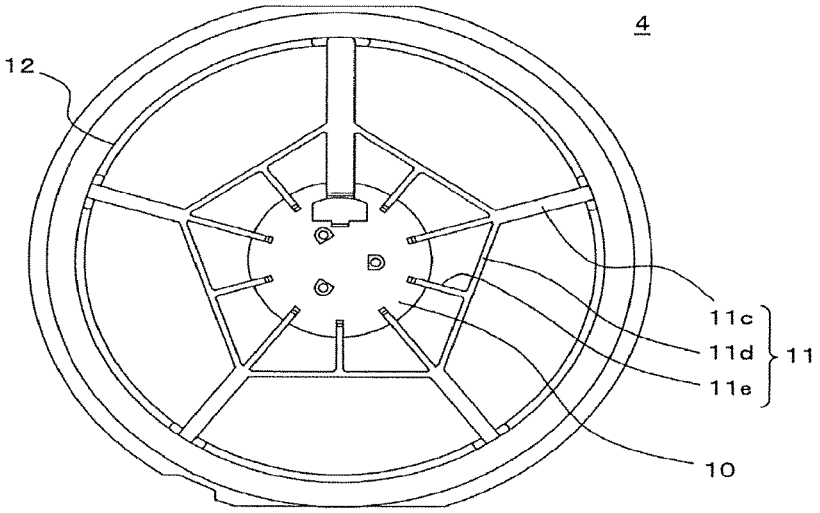
FIG. 9 is a bottom view of another exemplary air-blowing device included in the indoor unit according to Embodiment 2 of the present invention.

FIG. 8 is a bottom view of an exemplary air-blowing device included in an indoor unit for an air-conditioning apparatus according to Embodiment 2 of the present invention. FIG. 9 is a bottom view of another exemplary air-blowing device included in the indoor unit according to Embodiment 2 of the present invention.

As illustrated in FIGS. 8 and 9, an air-blowing device 4 in Embodiment 2 includes a motor stay 11 including a plurality of (six in FIG. 8; five in FIG. 9) rod-shaped members 11*c* radially extending from a motor base 10 to an inner surface of a bellmouth 12 and a plurality of rod-shaped members 11*d* each connecting the adjacent rod-shaped members 11*c*. The rod-shaped members 11*c* correspond to first rod-shaped members in the present invention and the rod-shaped members 11*d* correspond to second rod-shaped members in the present invention.

In Embodiment 2, the rod-shaped members 11*d* connected to the same rod-shaped member 11*c* correspond in position to each other. Consequently, the rod-shaped members 11*d* are arranged in the form of a polygon (hexagon in FIG. 8; pentagon in FIG. 9). The motor stay 11 of the air-blowing device 4 in Embodiment 2 further includes rod-shaped members 11*e* connecting the rod-shaped members 11*d* to the motor base 10 to reduce vibrations of the rod-shaped members 11*d*, that is, reduce noise caused by the vibrations.

In a typical axial-flow or diagonal-flow air-blowing device, if pressure loss caused by a component, such as a dust collecting filter or the heat exchanger 5, located in a passage occurs upstream or downstream of the air-blowing device, air passing through the air-blowing device will flow mainly through circumferentially outer part of the fan. Accordingly, if a component obstructing air flow exists downstream of the air-blowing device such that the component is located downstream of the circumferentially outer part of the fan, air flowing through the circumferentially outer part of the fan would collide with the component, thus disturbing the air flow. This would result in a reduction in power efficiency and an increase in noise.

In Embodiment 2, the motor stay 11 includes the rod-shaped members 11*c* radially extending from the motor base 10 to the inner surface of the bellmouth 12. Such a structure allows reduction of the number of positions at which the rod-shaped member 11*c* is mounted to the inner surface of the bellmouth 12.

In Embodiment 2, the motor stay 11 includes the rod-shaped members 11*d* for connecting the adjacent rod-shaped members 11*c*. Consequently, a downstream edge of each blade 15 intersects the motor stay 11 at a given angle in plan view at all times during rotation of the fan 13, that is, irrespective of the angle of rotation of the fan 13. This reduces periodic pressure fluctuations on each blade 15 caused by interference of the motor stay 11 and a slipstream generated by the blade 15.

The structure of an indoor unit 100 according to Embodiment 2 can reduce generation of discrete frequency noise, and allows improvement of the power efficiency of the indoor unit 100.

In Embodiment 2, the rod-shaped members 11*d* are arranged in the polygonal form. Consequently, a point where the downstream edge of each blade 15 intersects the motor stay 11 in plan view is not kept at a given position during rotation of the fan 13. Thus, the distribution of pressure of a slipstream generated by each blade 15 in one rotation of the fan is made gentler. In other words, the interference of the heat exchanger 5 and the slipstream generated by each blade 15 is further reduced, thus further reducing periodic pressure fluctuations on the blade 15 caused by the interference of the motor stay 11 or the heat exchanger 5 and the slipstream generated by the blade 15. Advantageously, the generation of unpleasant discrete frequency noise can be further reduced, leading to further improved low-noise performance of the indoor unit 100.

Embodiment 3

The shape of a portion for mounting the rod-shaped member included in the motor stay 11 to the inner surface of the bellmouth 12 has not been mentioned in Embodiments 1 and 2. In other words, advantages obtained in Embodiments 1 and 2 are achieved irrespective of the shape of the portion for mounting the rod-shaped member included in the motor stay 11 to the inner surface of the bellmouth 12. For example, the mounting portion in the air-blowing device 4 in each of Embodiments 1 and 2 may have the following shape to achieve the following advantages. Note that the components which will not be mentioned in Embodiment 3 are the same as those in Embodiment 1 or 2 and the same parts and components as those in Embodiment 1 or 2 are designated by the same references.

Assuming that a heat exchanger is disposed downstream of an air-blowing device, the area of a passage in an air outlet of the air-blowing device (i.e., the area of the passage in the outlet of the bellmouth 12) is typically smaller than the area of the passage on an upstream side of the heat exchanger. Consequently, air flowing downstream of the air-blowing device is likely to flow toward an outer periphery of the air-blowing device. Assuming that an air-blowing device (disclosed in Patent Literature 2, for example) in which mounting portions for a motor stay are arranged within a bellmouth is included in an air-conditioning-apparatus indoor unit in which a heat exchanger is disposed downstream of the air-blowing device, an outlet end (downstream end) of the bellmouth is located downstream of a downstream end of a fan. Consequently, air passed through the fan flows through the bellmouth without spreading radially. Thus, air flow to pass through the heat exchanger tends to have a distribution of flow rate.

As described above, assuming that pressure loss caused by a component, such as a dust collecting filter or the heat exchanger 5, located in a passage occurs upstream or downstream of a typical axial-flow or diagonal-flow air-blowing device, air passing through the air-blowing device flows mainly through circumferentially outer part of the fan. If a component obstructing air flow is located within the bellmouth through which air flows at a high rate, air flowing through the circumferentially outer part of the fan would collide with the mounting portions, thus disturbing the air flow. This would cause pressure fluctuations on a surface of each blade of the fan, thus increasing a likelihood of generation of unpleasant discrete frequency noise.

A portion for mounting the rod-shaped member included in the motor stay 11 to the inner surface of the bellmouth 12 has the following shape in Embodiment 3.

FIG. 4 is an exploded perspective view of an air-blowing device in an indoor unit for an air-conditioning apparatus according to Embodiment 3 of the present invention.

As illustrated in FIG. 4, a bellmouth 12 of an air-blowing device 4 includes a plurality of mounting portions 16 arranged at an outlet end of the bellmouth 12 such that the mounting portions 16 protrude downwardly from the outlet end along the axis of rotation (hereinafter, "rotation axis") of a fan 13. Each of the mounting portions 16 has a base located upstream in the air flow and a free end located downstream in the air flow and has a substantially trapezoidal shape having a long side corresponding to the base and a short side corresponding to the free end. Rod-shaped members included in a motor stay 11 are connected to, for example, downstream ends of the mounting portions 16. Such a structure of the air-blowing device 4 allows the outlet end of the bellmouth 12 to be located upstream of a downstream end of the fan 13.

In the indoor unit 100 with the above-described structure, air flow passes mainly through a radially outer region within the bellmouth 12 during rotation of a fan 13. The air passed through the bellmouth 12 flows out of the outlet of the bellmouth 12 toward the outside of the air-blowing device 4. Since the mounting portions 16 protrude downwardly from the outlet end of the bellmouth 12, the air flowing out of the outlet of the bellmouth 12 flows between the adjacent mounting portions 16 toward the outside of the air-blowing device 4. Consequently, air flow is less likely to be obstructed, thus improving the flow rate distribution of air flow to pass through the heat exchanger 5.

Since each mounting portion 16 has a substantially trapezoidal shape, a side surface 17 of the mounting portion 16 facing a pressure surface 15*a* of each blade 15 has a large angular difference with respect to the angle of the blade 15. Consequently, when the blade 15 passes the mounting portion 16, a slipstream generated by the blade 15 gradually interferes with the mounting portion 16. Thus, pressure fluctuations on the surface of the blade 15 caused by the interference of the mounting portion 16 and the slipstream generated by the blade 15 are reduced, thereby further reducing generation of unpleasant discrete frequency noise. This leads to improved low-noise performance of the indoor unit 100. The side surface 17 corresponds to a first side surface in the present invention.

A noise reducing effect in an indoor unit 100 according to Embodiment 3 was confirmed by tests. This effect will now be described.

Figure 10A:
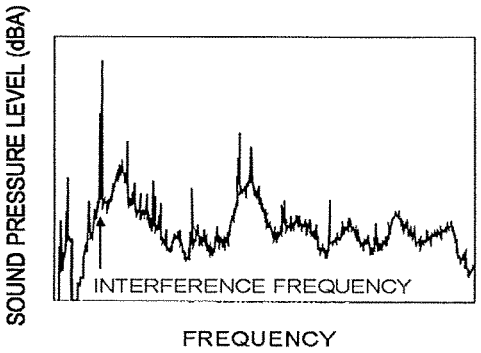
FIGS. 10A-10B include graphs for explaining frequency characteristics of noise in the indoor unit according to Embodiment 3 of the present invention.
Figure 10B:
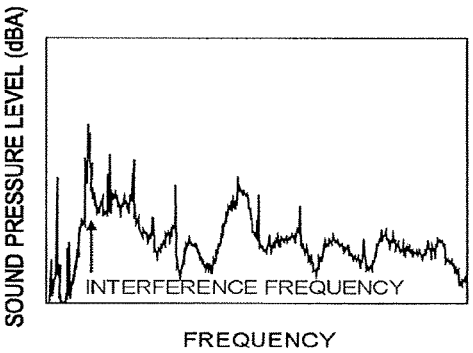

FIG. 10 includes graphs for explaining frequency characteristics of noise in the indoor unit according to Embodiment 3 of the present invention. Specifically, FIG. 10(*a*) illustrates frequency characteristics of noise in an indoor unit including a related-art air-blowing device (in this case, the indoor unit 100 including the related-art air-blowing device disclosed in Patent Literature 2). FIG. 10(*b*) illustrates the frequency characteristics of noise in the indoor unit 100 according to Embodiment 3.

As illustrated in FIG. 10(*a*), the frequency characteristics of noise in the indoor unit including the related-art air-blowing device have an extremely sharp peak at a frequency at which slipstreams generated by a fan interfered with mounting portions. On the other hand, as illustrated in FIG. 10(*b*), the frequency characteristics of noise in the indoor unit 100 including the air-blowing device 4 in Embodiment 3 have a smaller peak at a frequency at which slipstreams generated by the fan 13 interfered with the mounting portions 16, resulting in a reduction in discrete frequency noise unpleasant to the sense of hearing.

Embodiment 4

In Embodiment 3, each mounting portion 16 has a trapezoidal shape and the side surface 17 is substantially straight. The side surface 17 is not limited to such a substantially straight surface. It is only required that the side surface 17 is at an angle relative to the blade 15. For example, the side surface 17 of each mounting portion 16 may be shaped as follows. Note that the components which will not be mentioned in Embodiment 4 are the same as those in Embodiment 3 and the same parts and components as those in Embodiment 3 are designated by the same reference numerals.

Figure 11A:
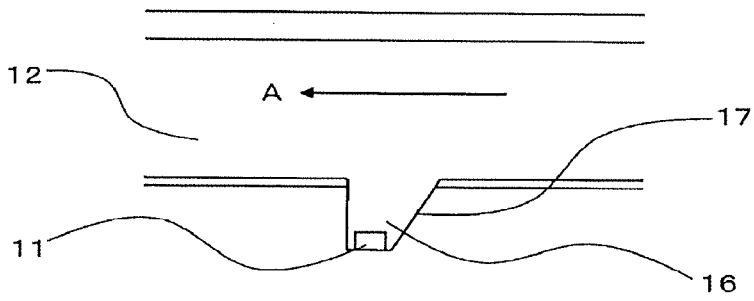
FIGS. 11A-11C include enlarged views of essential part of an indoor unit for an air-conditioning apparatus according to Embodiment 4 of the present invention, each view illustrating a mounting portion of an air-blowing device and its surroundings.
Figure 11B:
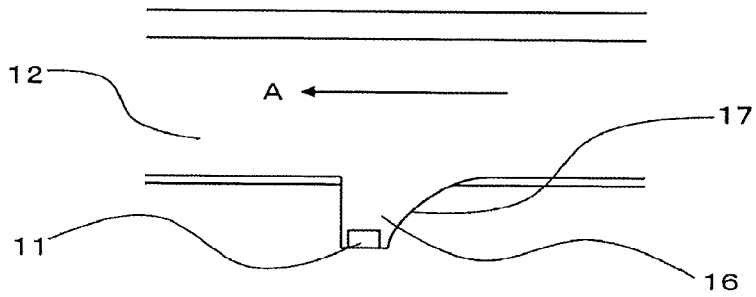
Figure 11C:
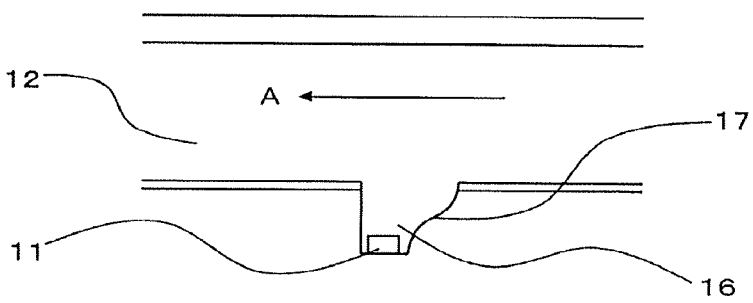

FIG. 11 includes enlarged views of essential part of an indoor unit for an air-conditioning apparatus according to Embodiment 4 of the present invention and each view illustrates a mounting portion of an air-blowing device and its surroundings. FIG. 11 illustrates examples of the shape of the mounting portion 16.

For example, referring to FIG. 11(*a*), a mounting portion 16 has a substantially straight side surface 17 like the mounting portion 16 in Embodiment 3. The side surface 17 slopes toward a downstream end of the mounting portion 16 in a rotating direction (indicated by arrow A in FIG. 11(*a*)) of a fan 13. A side surface opposite the side surface 17 is substantially straight and is substantially parallel to the rotation axis of the fan 13.

For example, referring to FIG. 11(*b*), the mounting portion 16 has a substantially arcuate side surface 17 such that the side surface 17 slopes toward the downstream end of the mounting portion 16 in the rotating direction (indicated by arrow A in FIG. 11(*b*)) of the fan 13. Like the mounting portion 16 illustrated in FIG. 11(*a*), the mounting portion 16 has a side surface opposite the side surface 17 which is substantially straight and is substantially parallel to the rotation axis of the fan 13.

Referring to FIG. 11(*c*), the mounting portion 16 has a substantially wavy side surface 17 such that the side surface 17 slopes toward the downstream end of the mounting portion 16 in the rotating direction (indicated by arrow A in FIG. 11(*c*)) of the fan 13. Like the mounting portions 16 illustrated in FIGS. 11(*a*) and (*b*), the mounting portion 16 has a side surface opposite the side surface 17 which is substantially straight and is substantially parallel to the rotation axis of the fan 13.

In each of the above-described mounting portions 16, the side surface 17 to most interfere with a slipstream generated by each blade 15 is at an angle relative to the blade 15. Consequently, a discrete frequency noise reducing effect similar to that in Embodiment 1 can be achieved. Additionally, the side surface opposite the side surface 17 in each of the above-described mounting portions 16 in Embodiment 4 is substantially straight and is substantially parallel to the rotation axis of the fan 13. This reduces the area of interference of the mounting portion 16 and a slipstream generated by each blade 15, leading to improved power efficiency.

REFERENCE SIGNS LIST

1 casing
1*a* bellmouth support
2 air inlet
2*a* fan guard
3 air outlet
4 air-blowing device
5 heat exchanger
6 passage
7 dust collecting filter
8 motor
9 air flow control vane
10 motor base

11 motor stay
11*a* to 11*e* rod-shaped member
12 bellmouth
13 fan
14 boss
15 blade
16 mounting portion
17 side surface
20 partition
100 indoor unit

The invention claimed is:

1. An indoor unit for an air-conditioning apparatus, the unit comprising:

a casing including an air inlet in an upper portion of the casing and an air outlet in a lower part of a front surface of the casing;

an air-blowing device including a bellmouth disposed to the air inlet, a fan of one of an axial-flow type and a diagonal-flow type disposed within the bellmouth, a motor for rotating the fan, a motor base holding the motor, and a motor stay connecting the motor base to the bellmouth, the fan including a plurality of blades, the motor stay including a plurality of members; and a heat exchanger disposed downstream of the air-blowing device and upstream of the air outlet within the casing, the heat exchanger exchanging heat between air discharged from the air-blowing device and a refrigerant, wherein the motor stay of the air-blowing device is configured such that, in plan view, a downstream edge of each of the blades of the fan intersects any of the members of the motor stay irrespective of an angle of rotation of the fan wherein the bellmouth includes a plurality of mounting portions protruding downwardly from an outlet end of the bellmouth, the outlet end being disposed downstream in an air flow direction, wherein the motor stay is connected to the mounting portions of the bellmouth, and wherein the mounting portions each include first and second side surfaces at respective circumferential upstream and downstream sides of each of the mounting portions relative to a direction of rotation of the fan and, of which at least the first side surface opposing a pressure surface of each of the blades of the fan is at an angle relative to a rotation axis of the fan and slopes in the direction of the rotation of the fan.

2. The indoor unit for the air-conditioning apparatus of claim 1, wherein the motor stay includes:

a plurality of first members extending radially from the motor base in plan view and connecting the motor base to the bellmouth; and a plurality of second members each connecting the adjacent first members.

3. The indoor unit for the air-conditioning apparatus of claim 2, wherein the second members are arranged in polygonal form, and vertexes of the polygonal form are on the first members.

4. The indoor unit for the air-conditioning apparatus of claim 1, wherein a plurality of members included in the motor stay are arranged in lattice form.

5. The indoor unit for the air-conditioning apparatus of claim 1, wherein the first side surface is one of straight, arcuate, and wavy in form.

6. The indoor unit for the air-conditioning apparatus of claim 1, wherein in at least one of the mounting portions, the second side surface opposite the first side surface is parallel to the rotation axis of the fan.

7. The indoor unit for the air-conditioning apparatus of claim 1, wherein the motor stay includes:

members extending radially from the motor base in plan view.

8. An air-conditioning apparatus comprising:

an indoor unit including a casing including an air inlet in an upper portion of the casing and an air outlet in lower part of a front surface of the casing, an air-blowing device including a bellmouth disposed to the air inlet, a fan of one of an axial-flow type and a diagonal-flow type disposed within the bellmouth, a motor for rotating the fan, a motor base holding the motor, and a motor stay connecting the motor base to the bellmouth, the fan including a plurality of blades, the motor stay including a plurality of members, and a heat exchanger disposed downstream of the air-blowing device and upstream of the air outlet within the casing, the heat exchanger exchanging heat between air discharged from the air-blowing device and a refrigerant, wherein the motor stay of the air-blowing device is configured such that, in plan view, a downstream edge of each of the blades of the fan intersects any of the members of the motor stay irrespective of an angle of rotation of the fan wherein the bellmouth includes a plurality of mounting portions protruding downwardly from an outlet end of the bellmouth, the outlet end being disposed downstream in an air flow direction, wherein the motor stay is connected to the mounting portions of the bellmouth, and wherein the mounting portions each include first and second side surfaces at respective circumferential upstream and downstream sides of each of the mounting portions relative to a direction of rotation of the fan and, of which the first side surface opposing a pressure surface of each of the blades of the fan is at an angle relative to a rotation axis of the fan and slopes in the direction of the rotation of the fan.

9. The indoor unit for the air-conditioning apparatus of claim 1, wherein at least one of the mounting portions has, in a circumferential direction, a long side corresponding to a base located an upstream side of the rotation axis of the fan, and a short side corresponding to a lower end located a downstream side of the rotation axis of the fan.

10. The indoor unit for the air-conditioning apparatus of claim 1, wherein the second side surface of at least one of the mounting portions is at an angle relative to the rotation axis of the fan, and slopes toward an opposite direction with respect to the direction of rotation of the fan, and the angle of the second side surface is smaller than the angle relative to the rotation axis of the fan of the first side surface of the at least one of the mounting portions.

11. The indoor unit for the air-conditioning apparatus of claim 1, wherein a recessed shape is formed between the mounting portions in a circumferential direction with respect to the direction of rotation of the fan, and the recessed shape is concave toward an upstream side of the rotation axis of the fan.

* * * * *